US005573483A

United States Patent [19]

Nay

[11] Patent Number: 5,573,483

[45] Date of Patent: Nov. 12, 1996

[54] KNEE WEIGHT FOR ABDOMINAL EXERCISE

[76] Inventor: Herschel D. Nay, 144 W. 4575 S., Ogden, Utah 84405-5929

[21] Appl. No.: 552,985

[22] Filed: Nov. 3, 1995

[51] Int. Cl.[6] ..... A63B 21/06

[52] U.S. Cl. ..... 482/105

[58] Field of Search ..... 482/92, 93, 105, 482/140, 148

[56] References Cited

U.S. PATENT DOCUMENTS 5,102,123 4/1992 Roark ..... 482/105

OTHER PUBLICATIONS

"Pre–Pak For Home Exercise"(advertisement) *American Journal Of Sports Medicine* 12 (Mar. 1984) copy in 402/105.

*Primary Examiner*—Richard J. Apley
*Assistant Examiner*—John Mulcany

[57] ABSTRACT

The knee weight for abdominal exercise is intended to be used as two identical units, with one unit placed over the area of each knee of a user while the knee is bent. Each unit has weight pockets to mount on opposite sides of a user's knee. Each weight pocket is capable of holding one or more weights. There is an upper adjustment strap that is placed over the front of the thigh; and a lower adjustment strap that is placed over the front of the shin. These adjustment straps adjust. There is a stabilizing strap that is behind the knee to secure the exercise device to the leg during use in length to accommodate different users.

4 Claims, 4 Drawing Sheets

KNEE WEIGHT FOR ABDOMINAL EXERCISE

BACKGROUND—FIELD OF INVENTION

This invention relates to the field of abdominal exercise devices.

BACKGROUND—DESCRIPTION OF PRIOR ART

Many kinds and types of exercise equipment have been developed in the past. Many are intended to exercise specific body parts. However, no single piece of exercise equipment will accomplish in the same manner what the present invention achieves. There are exercise weight devices that are put around the ankle or around the thigh, but they are not structured to fit around the knee. With this invention the abdomen, middle back, and the upper legs are worked. Presently it takes more than one known exercise machine to do the same exercise functions as the present invention. Even then some portions of the targeted muscles will not be properly exercised.

OBJECTS AND ADVANTAGES

The present invention targets and strengthens a specific area of the body. It is directed at strengthening the muscles of the abdomen, and toning the muscles of the middle back, inner and outer thighs, and the waist line areas for both men and women.

This invention uses weight pockets so that different combinations of weights can be used. There are two weight pockets per unit, and two units are required to complete the invention. Advantages of the invention are that it requires only a small workout area and it also requires only a small storage area. Additional advantages and features of the invention will become apparent to a person skilled in the art to which the invention pertains from the following drawings and detailed descriptions.

DETAILED DESCRIPTION

Figure 4A:
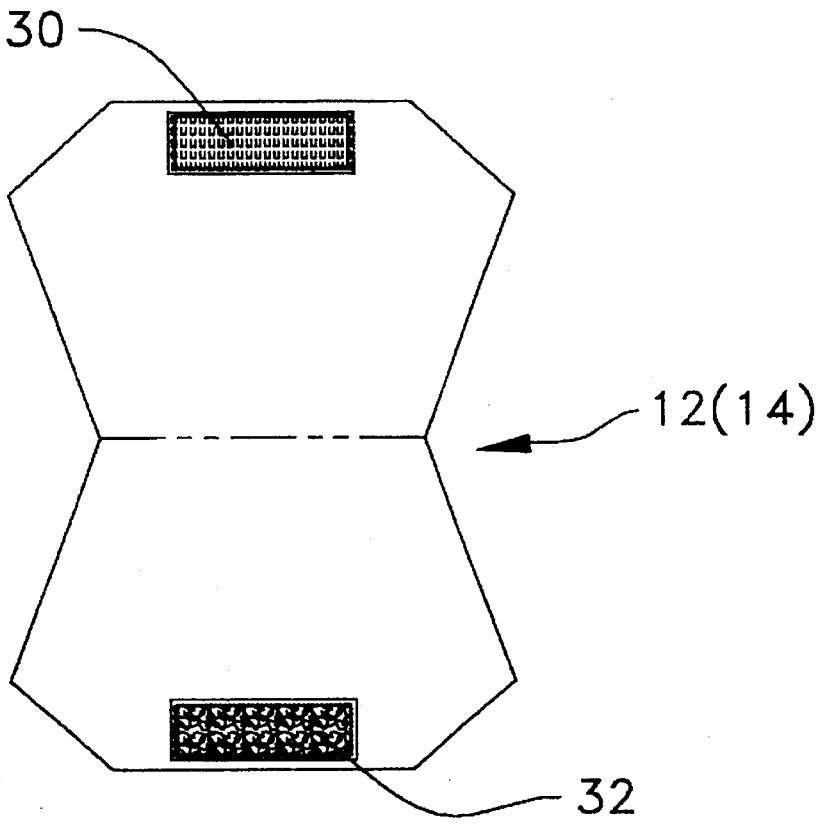
FIG. 4A is a plan view of flat fabric pattern for the weight pocket with hook and loop fastener sewn into place.
Figure 4:
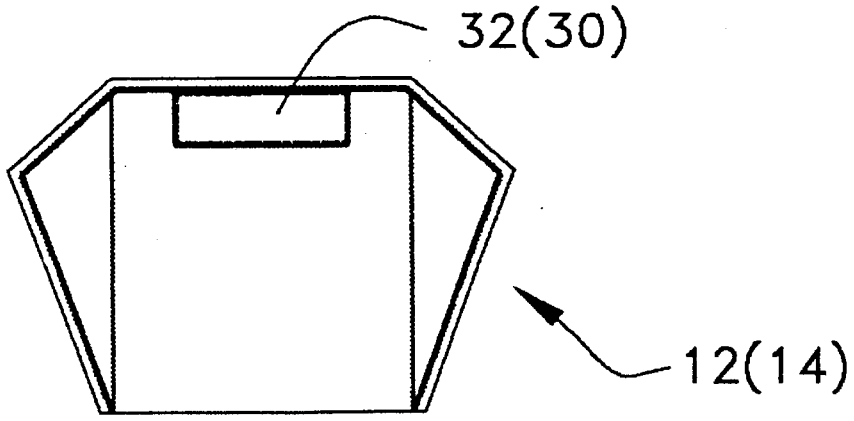
FIG. 4 is a side elevation view of the weight pocket, folded and sewn.
Figure 5:
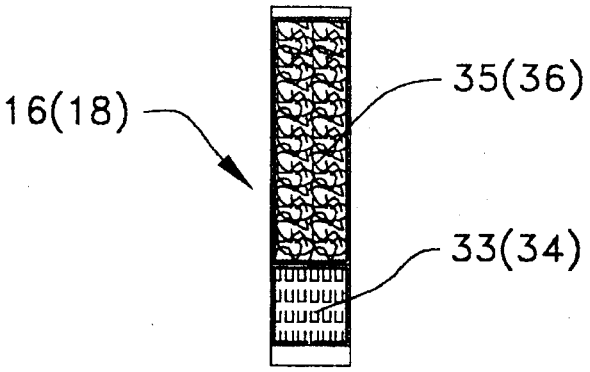
FIG. 5 is a top plan view of the adjustment strap with hook and loop fastener sewn in place.
Figure 6:
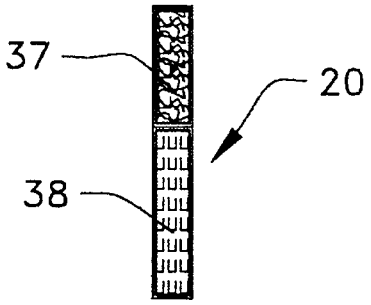
FIG. 6 is a top plan view of the stabilizing strap with hook and loop fastener sewn in place.
Figure 7A:
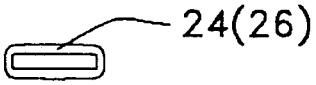
FIG. 7A is a top plan view of a typical large buckle used with the adjustment strap.
Figure 8A:
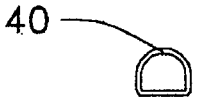
FIG. 8A is a top plan view of a typical small buckle used with the stabilizing strap.
Figure 7B:
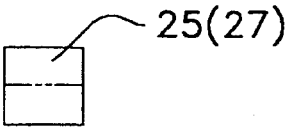
FIG. 7B is an elevation view of an attachment strap for a large buckle.
Figure 8B:
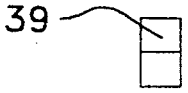
FIG. 8B is an elevation view of an attachment strap for a small buckle.
Figure 7:
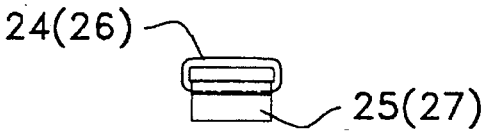
FIG. 7 is a fragmentary plan view of the assembled large buckle and attachment strap.
Figure 8:
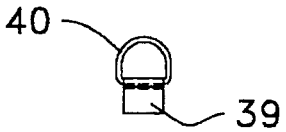
FIG. 8 is a fragmentary plan view of the assembled small buckle and attachment strap.

In the illustrated preferred embodiment, the abdominal exercise device of the invention as shown generally at 10 and includes fabric weight pockets 12 and 14 with adjustment straps 16 and 18, a stabilizing strap 20 and an off-the-shelf weight 22 are inserted into each of the pockets 12 and 14. It will be apparent that more than one weight 22 can be placed in each pocket, if desired. The adjustment straps 16 and 18 and stabilizing strap 20 each has one end sewn on weight pocket 12. Large buckles 24 and 26 and small buckle 40 are each sewn onto weight pocket 14 using attachment straps 25, 27 and 39 respectively. The weight pockets have hook 30 and look 32 fastener sewn on, as best viewed in FIGS. 4 and 4A. Each adjustment strap 16 and 18 has hook 33 (34) and loop 35 (36) fastener sewn thereon. Stabilizing strap 20 has hook 38 and loop 37 sewn thereon. The large buckles 24 and 26 are used to fasten the adjustment straps 16 and 18. A small buckle 40 is sewn to weight pocket 14 and cooperates with the stabilizing strap 20.

OPERATIONS

Figure 1:
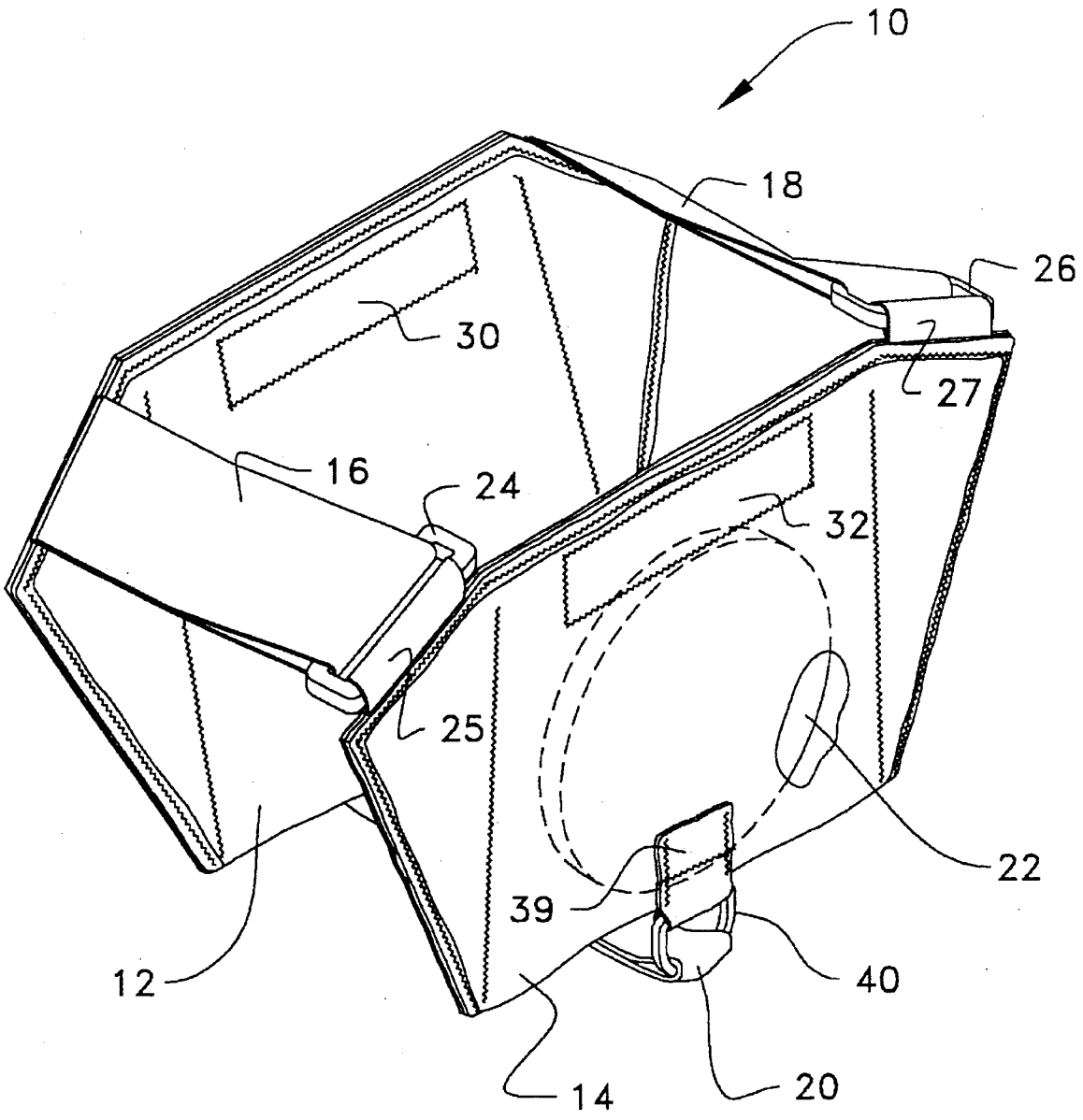
FIG. 1 is a prospective view of the assembled fabric exercise device partially out away to show a typical weight in a pocket of the device.
Figure 2:
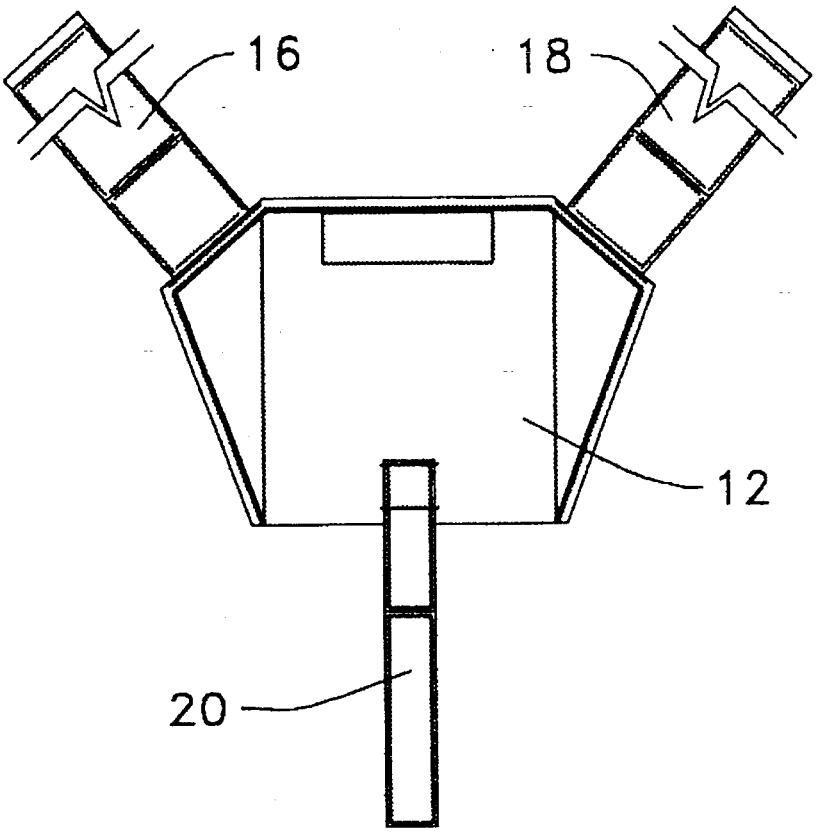
FIG. 2 is a side elevation view with two adjustment straps and one stabilizing strap shown extended.
Figure 3:
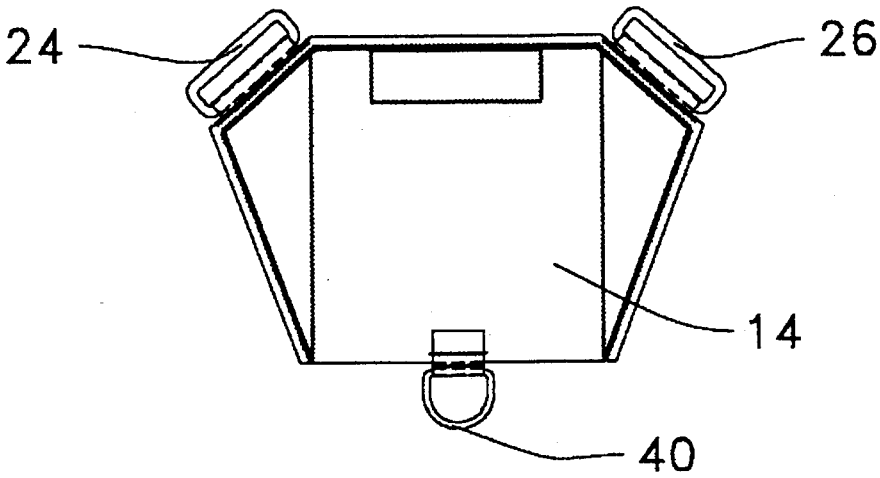
FIG. 3 is an opposite side view with two buckles to accompany the adjustment straps (FIG. 2) and one bottom buckle to accompany the stabilizing strap.

A user of this abdominal exercise device will join the weight pockets 12 and 14 (FIGS. 2 and 3) together by placing the adjustment straps 16 and 18 through the large buckles 24 and 26. The weight pockets are adjusted to fit across the user's knee by means of hook 33 (34) and loop 35 (36) fasteners. One of the adjustment straps is placed over the thigh and the other adjustment strap is placed over the shin of the user's leg. The stabilizing strap 20 goes behind the knee and through the buckle 40 (FIGS. 2 & 3) to stabilize the exercise device upon tightening of the strap through adjustment of the hook 38 and loop 37 fastener. Weights 22 placed in weight pockets 12 and 14 are secured by the hook 30 and loop 32 fasteners.

SUMMARY, RAMIFICATIONS AND SCOPE

The present invention gives the user the ability to adjust the fit of the exercise device and the amount of weights used. Virtually anyone can use and benefit from this exercise device. The user will perform a variety of special exercises with this present device, which will also be an addition to any conventional exercises and existing exercise program. While performing sit ups, the added weight at the knees, will help to stabilize the legs and keep the feet securely on the floor. This gives the user a more controlled workout. When properly used, the present exercise device strengthens the abdomen, back and legs. Consequently, a user's posture and leg strength will improve. Although not specifically intended to reduce waist size, such a reduction often results with proper use. The present invention is used primarily to strengthen specific areas of the body for increased body "torque." With this present invention, only a small area is needed to do the exercises and the apparatus requires a small storage area. A comparable workout with other equipment generally, requires the expense of more than one exercise machine and a large workout area. The user of this present invention does not have to be an athlete in order to tone and strengthen his body. The major exercises used with this device target the hard to reach areas of the user's body like the abdomen, waist line, inner and outer thighs and the middle back. Basic special exercises for this device include: 1. The user will place the exercise device over the knee and adjust and tighten it into place with the stabilizing and adjustment straps. The user begins by lying on his back, knees bent and together with feet flat on the floor. The user will rotate the knees from side to side as far as possible (trying to touch the knees on the floor); 2. The user will keep the knees bent and together, feet on the floor and turn his knees out to the sides in a butterfly motion; 3. In a variation of exercise 2, the user will lie on the floor with knees bent, turn one knee out placing one foot over the other and raise the foot and leg that is turned out off the floor and lower to the starting position, repeated on the opposite side. 4. The user lying on his side will keep knees bent and together, and raise the knee keeping the feet together and lower to the starting position, the user will then repeat on the opposite side; and 5 The user will remain on his side, as in exercise 4, and raise the knee and foot off the floor, and repeat on the opposite side.

While a preferred embodiment of my invention has been herein described, it is intended that the invention will be set forth in the following claims:

I claim:

1. A knee weight for abdominal exercise comprising of a pair of weight receiving pockets; a flexible means interconnecting said pairs of weight receiving pockets and having an opening to receive the knee of a user when said weight receiving pockets are positioned on said user's leg at opposite sides of the knee; strap means interconnecting said pair of weight receiving pockets positioned to pass beneath the when said weight receiving pockets are so positioned and adjustable to tighten said pockets on the leg and weights in the said weight receiving pockets.

2. A knee weight for abdominal exercise device as in claim 1, wherein the flexible means interconnecting the pairs of weight receiving pockets comprises spaced apart straps defining said opening therebetween.

3. A knee weight for abdominal exercise as in claim 2, wherein said straps are adjustable to tighten said pockets on the leg and include a buckle and hook and loop fasteners.

4. A knee weight for abdominal exercise as in claim 2, wherein the strap means interconnecting said pair of weight receiving pockets positioned to pass beneath the knee includes a buckle and a hook and loop fastener.

* * * * *